US005844350A

United States Patent [19]

Scott et al.

[11] Patent Number: 5,844,350

[45] **Date of Patent: *Dec. 1, 1998**

[54] COATED ARC TUBE FOR SODIUM VAPOR LAMP

[75] Inventors: Curtis E. Scott, Mentor; Charles I. McVey, Auburn Township, both of Ohio

[73] Assignee: General Electric Company, Schenectady, N.Y.

[ * ] Notice: The portion of the term of this patent subsequent to Dec. 14, 2010, has been disclaimed.

[21] Appl. No.: 995,635

[22] Filed: Dec. 18, 1992

[51] Int. Cl.[6] ..... H01J 1/62

[52] U.S. Cl. ..... 313/25; 313/489; 313/634; 313/635

[58] Field of Search ..... 313/489, 634, 313/635, 25; 427/106, 126.3

[56] References Cited

U.S. PATENT DOCUMENTS

| | | | |
|---|---|---|---|
| 3,377,498 | 4/1968 | Koury et al. | 313/635 |
| 3,723,784 | 3/1973 | Sulcs et al. . | |
| 3,851,200 | 11/1974 | Thomasson | 313/635 |
| 3,889,142 | 6/1975 | Keeffe | 313/635 |
| 4,033,743 | 7/1977 | Scott, Jr. et al. | 65/30.1 |
| 4,047,067 | 9/1977 | Clausen | 313/567 |
| 4,079,167 | 3/1978 | Scott, Jr. et al. | 428/409 |
| 4,256,988 | 3/1981 | Coaton et al. | 313/579 |
| 4,285,732 | 8/1981 | Charles et al. | 501/101 |
| 4,580,075 | 4/1986 | Strok | 313/25 |
| 4,690,727 | 9/1987 | Scott et al. | 156/635 |
| 5,017,551 | 5/1991 | Agostinelli et al. | 505/1 |
| 5,258,689 | 11/1993 | Jansma et al. | 313/489 |
| 5,270,615 | 12/1993 | Chang | 313/635 |

*Primary Examiner*—Sandra L. O'Shea
*Assistant Examiner*—Vip Patel
*Attorney, Agent, or Firm*—Edward M. Corcoran

[57] ABSTRACT

High pressure sodium arc vapor discharge lamps employing an alumina arc tube exhibit less voltage rise and better lumen maintenance over the life of the lamp when the arc tube is coated with an oxide of a metal selected from the group consisting essentially of yttrium, zirconium, hafnium, lanthanum, dysprosium, scandium and mixture thereof.

12 Claims, 2 Drawing Sheets

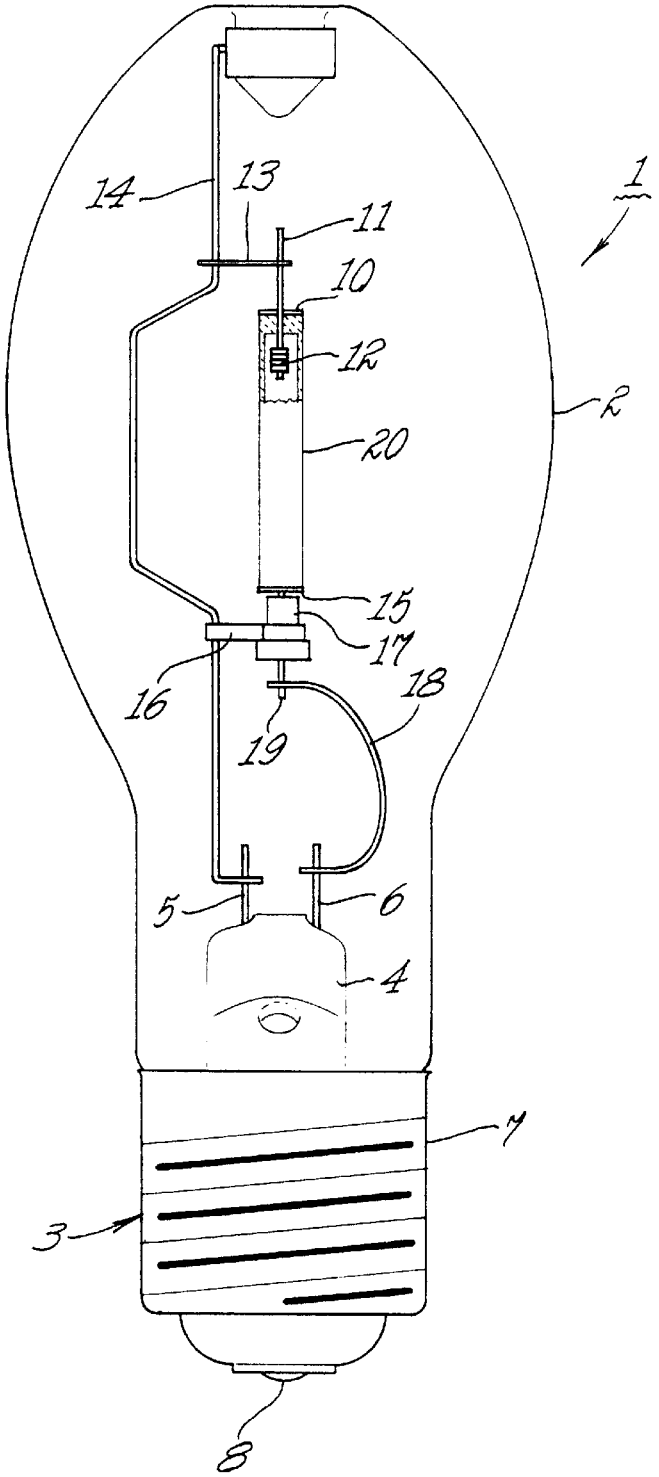
Fig. 1(a)
Fig. 1(b)
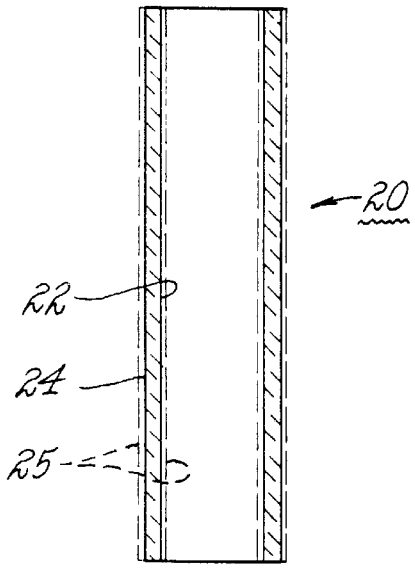
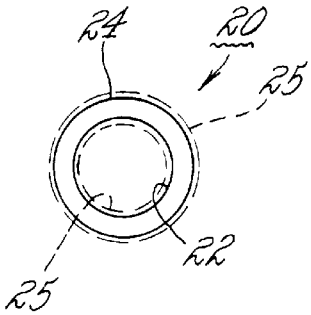
Fig. 1(c)

COATED ARC TUBE FOR SODIUM VAPOR LAMP

BACKGROUND OF THE INVENTION

1. Field of the Invention

The present invention relates to alumina arc tubes coated with refractory metal oxide and their use for arc discharge lamps. More particularly, this invention relates to alumina arc tubes coated with an oxide of one or more metals selected from the group consisting essentially of Y, Hf, Zr, Sc, La, Dy and mixture thereof and high pressure sodium vapor arc discharge lamps containing same.

2. Background of the Disclosure

High pressure sodium arc discharge lamps (hereinafter HPS lamps) are well known and old to those skilled in the art. These lamps employ a sodium arc discharge within an alumina arc discharge tube as the light source. The alumina arc tube, in turn, is enclosed within a vitreous or glass outer lamp envelope. The alumina arc tube is made of either sintered polycrystalline alumina (PCA) or single crystal alumina also known as sapphire. A major source of failure of an HPS lamp is loss of sodium from the arc. This sodium loss results in decreasing light or lumen output, color shift and voltage rise, eventually leading to lamp failure. A primary cause of sodium loss occurs due to reaction of the sodium with the alumina to form beta alumina and subsequent diffusion of the sodium out of the arc tube. This reaction is known to be thermodynamically favorable under temperature and pressure conditions which exist inside the arc tube of an operating HPS lamp and is exacerbated with increasing temperature and pressure.

On the other hand, it is also known that raising the temperature and pressure within the alumina arc tube of an HPS lamp increases the lamp efficacy or light output in lumens per watt and also improves its color rendering index which means that as the pressure and temperature are raised the light emitted by the arc gets whiter in color, and objects illuminated by such light, such as automobiles in a parking lot, exhibit their truer colors. On the other hand, raising the temperature and pressure exacerbates sodium depletion from the arc and, if the temperature of the alumina arc tube exceeds about 1100° or 1150° C., evaporation of the alumina from the outer arc tube wall greatly increases which causes darkening of the vitreous outer envelope of the lamp with a concomitant decrease in lumen output. That is, outer jacket darkening is believed to be caused by the volatilization of the alumina arc tube material and the subsequent condensation of the resultant vapor species on the cooler, inside wall of the vitreous outer jacket of the lamp. This condensation results in a drop in lamp performance due to the decreased light transmission of the outer jacket. It also produces an increase in the lamp operating temperature which further increases the alumina volatilization rate, thereby accelerating the ultimate end of the lamp life.

Accordingly, a need exists for an alumina arc tube or arc chamber suitable for use in an HPS lamp which is capable of withstanding higher pressures and temperatures for whiter light output and greater CRI and also for increasing lamp life of conventional HPS lamps.

SUMMARY OF THE INVENTION

It has now been discovered and forms the basis of the invention that an HPS lamp employing an alumina arc tube coated with oxide of a metal selected from the group consisting essentially of Y, Zr, Hf, La, Dy, Sc and mixture thereof overcome some of the deficiencies of prior art HPS lamps wherein the arc tubes do not have the coatings of the invention. Coating the interior wall surface of the alumina arc tube reduces sodium depletion from the arc and subsequent diffusion of the sodium through the arc tube. Coating the exterior surface of the arc tube reduces evaporation of the alumina species from the outer arc tube wall and concomitant condensation of such species onto the interior surface of the vitreous outer envelope which results in lamp darkening. Thus, the invention relates to an alumina arc tube coated with an oxide of one or more metals selected from the group consisting essentially of Y, Zr, Hf, La, Dy, Sc and mixture thereof on its interior surface, on its exterior surface, or on both the interior and exterior surfaces of the arc tube, and also to HPS lamps employing such coated arc tubes. Yttrium oxide or yttria is particularly preferred. HPS lamps using coated alumina arc tubes according to the invention exhibit longer life with less voltage rise and less decrease in lumen output and CRI over the life of the lamp. Furthermore, HPS lamps using coated alumina arc tubes of the invention may be operated at higher temperature and pressure than prior art HPS lamps using uncoated alumina arc tubes and still provide reasonable lamp life along with whiter color, high CRI and lower voltage rise over the life of the lamp compared to prior art HPS lamps using uncoated alumina arc tubes. By alumina arc tubes is meant both polycrystalline alumina arc tubes and single crystal alumina arc tubes also called sapphire tubes. By mixture of oxides of Y, Zr, Hf, La, Dy, Sc is meant mixtures of the individual oxides themselves, as well as intermetallic oxides.

BRIEF DESCRIPTION OF THE DRAWINGS

FIGS. 1(*a*), 1(*b*) and 1(*c*) schematically illustrate a jacketed HPS lamp employing an alumina arc tube having a metal oxide coating on at least one wall portion thereof according to the present invention and a hollow alumina tube used in making such arc tubes employing a metal oxide coating on both the interior and exterior wall thereof according to the invention.

DETAILED DESCRIPTION

Figure 2:
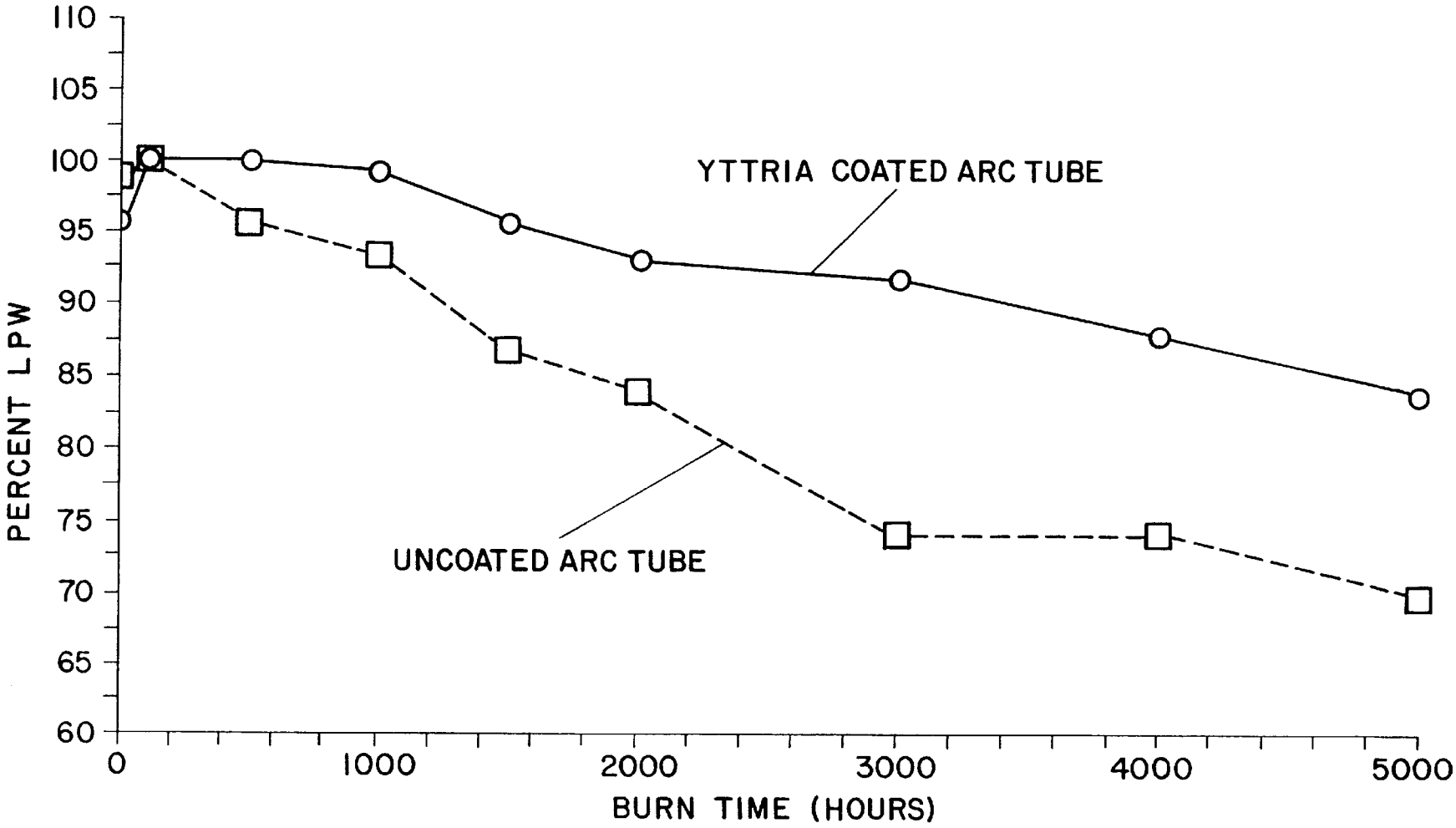
FIG. 2 is a graph illustrating improved lumen maintenance of HPS lamps having an yttria coating on the alumina arc tube according to the present invention compared to prior art HPS lamps or having no coating on the alumina arc tube.

Referring to FIG. 1(*a*), a typical HPS lamp 1 is illustrated comprising vitreous outer envelope 2 made of glass and having a standard metal screw base 3 comprising metal screw shell 7 and eyelet 8. Relatively heavy inlead conductors 5 and 6 extend through reentrant stem press seal 4 and are attached at one end to metal screw shell 7 and eyelet 8 by means not shown for supplying electricity to the arc and support for the arc tube. Light-transmissive alumina arc tube 20 is centrally located within outer envelope 2 with its upper end hermetically sealed by a polycrystalline alumina end closure member 10 through which extends a niobium inlead wire 11 also hermetically sealed in said end closure member. Inlead 11 supports an upper thermionic electrode 12 contained within arc tube 20 and may be generally similar to a lower thermionic electrode (not shown) in the opposite end of the arc tube and with both electrodes having the same general construction. The external portion of lead 11 connects to a transverse support wire 13 attached to side rod support member 14. Lower end closure member 15 for said arc tube 20 has a central aperture through which extends said bottom thermionic electrode (not shown). The hermetically sealed arc tube is physically supported in the outer envelope by the metal ribbon 16 which is welded to side rod 14, and electrically insulated from conductive inlead 19 by a ceramic insulating bushing 17. This type of HPS lamp construction is well known to those skilled in the art.

FIGS. 1(*b*) and 1(*c*) schematically illustrate an alumina arc tube having a metal oxide coating 25 according to the invention on both the interior wall portion 22 and the exterior portion 24. Thus, interior wall 22 and exterior wall 24 of alumina arc tube 20 both contain a coating 25 of an oxide of one or more metals selected from the group consisting essentially of Y, Zr, Hf, La, Sc, Dy and mixture thereof.

As set forth above, alumina tubes useful for coating as arc tubes for the practice of the invention include both polycrystalline alumina and single crystal alumina or sapphire arc tubes, both of which are commercially available and well known to those skilled in the art. At the present time, single crystal alumina tubes commercially available and used for making HPS arc tubes are considerably more expensive than polycrystalline alumina tubes and are somewhat more brittle, although they are more light transmissive and more resistant to sodium diffusion than polycrystalline alumina arc tubes. Nevertheless, coating either PCA arc tubes or single crystal alumina or sapphire arc tubes inside, outside, or both inside and outside with a coating according to the practice of the invention will result in improvement in reducing sodium depletion of the arc and reaction of the sodium with the arc tube and diffusion through the arc tube. Coating the outside of either type of these arc tubes with a coating according to the practice of the invention will reduce sublimation or transfer of aluminum oxide species from the outer wall of the arc tube to the cooler interior surface of the vitreous outer envelope during lamp operation and also enable such arc tubes to be used at higher operating pressure.

Polycrystalline alumina arc tubes are commercially available and well known to those skilled in the art. These arc tubes are formed by sintering an extruded green tube at elevated temperature and are made from substantially pure (i.e., 99.9+%) alumina along with minor amounts of MgO to promote sintering and uniform grain growth. These polycrystalline alumina arc tubes may also contain one or more refractory metal oxides such as $Y_2O_3$, $ZrO_2$, $HfO_2$, $Dy_2O_3$ and the like. U.S. Pat. No. 4,285,732 discloses the manufacture of a polycrystalline alumina tube useful for making arc tubes for HPS lamps useful in the practice of the invention. In this patent the alumina is disclosed as containing very minor amounts of magnesia and at least one component selected from the group consisting of zirconia, hafnia, and mixture thereof.

In the practice of the present invention, it has been found to be helpful if the outer surface of the alumina arc tube is polished either mechanically or chemically prior to depositing the metal oxide coating on the arc tube. In the case of a sapphire arc tube, the polishing is generally done mechanically. In the case of a polycrystalline alumina or PCA arc tube, a flux polishing treatment may be employed as disclosed in U.S. Pat. Nos. 4,033,743 and 4,079,167. In such treatments the unpolished polycrystalline alumina ceramic tube is immersed in a molten flux of alkali metal salt and binary oxide systems having an alkali metal oxide constituent which dissolves the surface alumina grains and produces a relatively smooth surface appearance. In a flux polishing treatment, the high spots of the individual surface alumina grains are reduced without materially etching the grain boundaries and the flux residue is removed from the treated ceramic generally by acid washing at ambient temperature. U.S. Pat. No. 4,690,727 discloses another chemical polishing method which employs a glaze coating wherein an alkali metal borate frit is applied to the outside surface, inside surface or both of the polycrystalline alumina tube which is heated up to liquify on the alumina and dissolve that portion of the alumina grains protruding from the surface. After that, the frit is removed by immersion in an acid bath. These chemical polishing processes remove the high spots of the individual alumina grains on the surface of the alumina without etching the grain boundaries and are useful for producing a smooth substrate on the surface of the polycrystalline alumina arc tube prior to coating with the metal oxide coating. If the sapphire alumina arc tube is not smooth and polished or if the polycrystalline alumina arc tube is not polished prior to application of the metal oxide coating, it has been found that the coating tends to fill up the crevices and any minor cracks at the grain boundaries, which can result in a discontinuous coating which is not as preferred as a continuous coating. It is preferred that the coating be continuous. Thus, the use of unpolished alumina will require the application of greater amounts of coating material in order to cover the high spots of the unpolished alumina surface particles and achieve a substantially continuous coating on the alumina surface.

While not wishing to be held to any particular theory, coating the inside of the arc tube with a coating of refractory metal oxide according to the practice of the invention is believed to reduce sodium loss by acting as a barrier to reduce reaction of the ionized sodium inside the arc tube with the alumina of the arc tube during operation of the HPS lamp, to form sodium aluminate and beta alumina. Beta alumina tends to grow along grain boundaries of polycrystalline alumina in a dendritic or finger-like fashion, which ultimately bridges the distance between the inner and outer wall of a polycrystalline alumina arc tube. When the beta alumina phase has grown across the arc tube wall, sodium loss becomes extremely rapid, because the beta alumina is known to be a good conductor for sodium ions. Coating the outer surface of the alumina with a refractory metal oxide coating according to the invention reduces the vaporization or sublimation of the alumina species from the outer surface of the arc tube, particularly at temperatures 1150° C. or higher, during operation of the HPS lamp, with subsequent condensation of such species on the cooler inside surface of the vitreous exterior envelope which causes the exterior envelope to slowly darken and substantially reduce lumen output. Consequently, for most applications in HPS lamps according to the practice of the invention, the alumina arc tube will contain the coating on both the inner and outer surfaces.

As the arc tube coating according to the practice of the invention will be an oxide of one or more metals selected from the group consisting essentially of Y, Zr, Hf, La, Dy, Sc and mixture thereof, it is possible to prepare coated arc tubes wherein both the inside and outside surfaces of the alumina are coated with different metal oxides, with the inner coating selected to be more stable to sodium attack and the outer coating being selected to suppress evaporation or sublimation of alumina species. The metal oxide coating or coatings may be applied to the alumina arc tube by a number of different methods, the selection of which is left to the convenience of the practitioner. These methods include dip-coating into aqueous or organic sols, or slurries of oxides or organo-metallic compounds such as metal alkoxides in organic solutions, slurries of extremely fine particle size metal oxides, formation of the oxide by decomposition of organo-metallic precursors in the vapor state and chemical vapor deposition of suitable decomposable metal oxide precursors such as yttrium trichloride, a metal acetyl acetonate such as yttrium or zirconium acetyl acetonate, rare earth metal acetyl acetonate, a metal dionate such as yttrium 2,2,6,6 tetramethyl-3,5 heptanedionate, tris (cyclopentadienyl)M wherein M is a metal according to the invention (e.g., Y), chelated metal compounds such as beta-diketonates, etc., the choice being left to the practitioner.

Coating thicknesses of metal oxide varying between about 1 to 5 micrometers have been achieved in a facile manner by dipping the arc tubes into an aqueous sol of the desired metal oxide (i.e., yttria) containing a water soluble organic liquid and binder to minimize cracking of the coating due to stresses caused by subsequent evaporation of the water and to facilitate handling prior to and during heating to melt and fuse the metal oxide sol into a continuous coating of metal oxide. For example, yttria coatings have been applied to both the inside and outside surfaces of polycrystalline alumina arc tubes employing a dipping process by dipping the arc tube in an aqueous sol of yttria obtained from Nycol Products comprising a 14 wt. % suspension of submicron particle size (i. <0.1 $\mu$m) yttria ($Y_2O_3$) in water and acid stabilized, to which was added methanol, water and polyvinyl pyrrolidone as a binder, along with formamide to reduce cracking during drying. Similar arc tubes were made with an aqueous, acid stabilized zirconia ($ZrO_2$) sol also obtained from Nycol, water, polyvinyl pyrrolidone, methanol and formamide. After the arc tubes were coated with the yttria or zirconia, they were air-dried at room temperature for a period of hours and then overnight at 100° C., after which they were slowly heated using a ramping schedule, up to 1500° and held at that temperature for ninety minutes for a total of 280 minutes from room temperature to the end of the 90 minute temperature hold at 1500° C. The so-applied yttria and zirconia coatings were analyzed by optical and scanning electronmicroscopy and the surfaces of the coated arc tubes were evaluated with X-ray diffraction and ESCA. Photometry measurements employing a photometer were used to measure lumen output as a function of burning time of lamps made from these arc tubes as set forth below.

Polycrystalline alumina arc tubes coated with a coating of zirconia were also made from mixed primary and secondary zirconium alkoxide. Mixed zirconium alkoxides were prepared by an exchange reaction of zirconium n-propoxide with 1-amyl alcohol. Activating the surface of the polycrystalline alumina arc tube with phosphoric acid for a few minutes improved adhesion of the subsequently formed zirconia coating to the arc tube and provided relatively crack-free coatings throughout the surface thereof. A homogeneous zirconia coating at a thickness of between 200–300 Å thick was obtained on polycrystalline alumina arc tubes from such a mixed alkoxide precursor solution by dipping under a nitrogen atmosphere employing about 30 wt. % of the mixed alkoxide in 1-amyl alcohol. The alkoxide-coated arc tube was heated at 500° C. for three hours to convert the precursor to zirconia and arc tubes coated with zirconia employing this process heated at 1200° C. for over 170 hours retained their physical integrity on cycling back down to room temperature, despite the known phase transition, with its associated volume change, which occurred at 1145° C. At 1600° C. the integrity of the zirconia coating began to break down.

A number of HPS lamps of the type generally illustrated in FIG. 1 were prepared using both coated and uncoated polycrystalline alumina arc tubes having an inside and outside diameter of about 5 and 6.5 mm, respectively, with a wall thickness of approximately 0.75 mm and an arc tube length of about 40 mm. The arc gap distance in mm was 16. The lamps were based on a design of a conventional 70 watt HPS lamp which had an arc gap of 20 mm. The electrode tip-to-seal distance was increased by 2 mm at each end to permit hotter arc tube temperatures without adversely effecting the seals at each end of the arc tube and this decreased the arc gap length to 16 mm. The lamps were designed to operate at 70 watts and were operated at 70, 120 and 150 watts which gave a wall loading in V/cm$^2$ of 21, 37 and 46, respectively. The arc tube center wall temperature was about 1040° C., 1235° C. and 1315° C. at operating wattages of 70, 120 and 150. Operation of these lamps showed that lamps having arc tubes coated with an yttria coating applied to both the inside surface and outside surface (using the sol dipping technique described above) exhibited reduced sodium attack and reduced sodium aluminate formation in the arc tube wall. The yttrium oxide was 2–3 $\mu$m thick both on the inside and outside arc tube wall surfaces. Lamps were tested over 5000 hours of burning time which showed that the coated lamps had as much as a 25% better lumen maintenance due to reduced outer jacket darkening and a substantially greater survival rate than the same lamps having uncoated arc tubes. Second order effects of less voltage rise and color temperature shift were observed particularly for the 71% over wattage (120 watt) test suggesting substantially lower sodium loss rate.

FIG. 2 is a graph of the HPS lamps which were run at 150 watts having both uncoated PCA arc tubes and PCA arc tubes coated inside and outside with yttria. One immediately sees the substantially greater percent lumen light output maintenance over 5000 hour burning time for the lamps having the yttria coated alumina arc tubes according to the invention, as compared to the same lamps having uncoated alumina arc tubes.

Similar HPS lamps were made, but designed to operate at 250 watts. These lamps used uncoated PCA arc tubes and arc tubes coated (dip coated into a zirconia sol, etc., as described above) with zirconia on both the inside and outside surfaces of the arc tube. These lamps were operated at about 400 watts or roughly 50% over the design wattage. After about 1000 hours of operation, the lamps having the zirconia coated arc tubes exhibited less outer jacket darkening. Microscopic examination of the interior arc tube walls revealed less sodium attack for the zirconia coated arc tubes.

The foregoing embodiments are intended to be illustrative, but non-limiting with respect to the practice of the invention. Some departure from these embodiments is permissible within the scope of the invention as those skilled in the art will know and appreciate.

What is claimed is:

1. A hollow alumina tube suitable for use as an arc tube for a sodium vapor arc discharge lamp, wherein an interior surface and an exterior surface of said tube are essentially continuously coated with a coating of oxide of at least one metal selected from the group consisting of Y, Hf, La, Zr, Dy, Sc and mixture thereof.

2. An arc tube according to claim 1 wherein said metal oxide coating on said interior surface is different in composition from said metal oxide coating on said exterior surface.

3. A hollow alumina tube suitable for use as an arc discharge tube for a sodium vapor arc discharge lamp, wherein said alumina tube is selected from the group consisting of polycrystalline alumina and single crystal alumina and wherein at least one of an interior surface and an exterior surface is essentially continuously coated with a transparent oxide of a metal selected from the group consisting of Y, Hf, La, Zr, Dy, Sc and mixture thereof.

4. An alumina tube according to claim 3 wherein said metal oxide coating is present on both said interior and said exterior surfaces of said tube.

5. An alumina tube according to claim 4 wherein the composition of said metal oxide coating on said interior surface of said tube is different from the composition of said metal oxide coating present on said exterior tube surface.

6. A high pressure sodium vapor arc discharge lamp comprising an alumina arc tube containing sodium and a pair of spaced apart electrodes hermetically sealed within wherein said alumina arc tube is made of polycrystalline alumina or single crystal alumina having both an interior surface and exterior surface and wherein said interior surface, said exterior surface or both said interior and said exterior surfaces of said arc tube are essentially continuously coated with a transparent oxide of a metal selected from the group consisting of Y, Hf, La, Zr, Dy, Sc and mixture thereof.

7. A lamp according to claim 6 wherein said arc tube is made of polycrystalline alumina.

8. A lamp according to claim 7 wherein said arc tube surface on which said coating is disposed is polished.

9. A lamp according to claim 8 wherein said coating comprises yttria.

10. A lamp according to claim 9 wherein said coating consists essentially of yttria and zirconia.

11. A lamp according to claim 8 wherein said coating consists essentially of yttria.

12. A hollow alumina tube suitable for use as an arc discharge tube for a sodium vapor arc discharge lamp, wherein said alumina tube is selected from the group consisting of polycrystalline alumina and single crystal alumina and wherein at least one of an entire interior surface and an entire exterior surface is essentially continuously coated with an oxide of a metal selected from the group consisting of Y, Hf, La, Zr, Dy, Sc and mixture thereof.

* * * * *